US009847580B2

(12) United States Patent
Wang et al.

(10) Patent No.: US 9,847,580 B2
(45) Date of Patent: Dec. 19, 2017

(54) PRINTED ANTENNA AND TERMINAL DEVICE

(71) Applicant: Huawei Device Co., Ltd., Shenzhen (CN)

(72) Inventors: Wen Wang, Shenzhen (CN); Qing Liu, Shenzhen (CN); Yao Lan, Shenzhen (CN); Zhenghao Li, Shenzhen (CN); Lintao Jiang, Shenzhen (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 361 days.

(21) Appl. No.: 14/579,897

(22) Filed: Dec. 22, 2014

(65) Prior Publication Data

US 2015/0102978 A1 Apr. 16, 2015

Related U.S. Application Data

(63) Continuation of application No. PCT/CN2014/082014, filed on Jul. 11, 2014.

(30) Foreign Application Priority Data

Jul. 31, 2013 (CN) ..... 2013 1 0329288

(51) Int. Cl.
*H01Q 9/04* (2006.01)
*H01Q 1/38* (2006.01)
(Continued)

(52) U.S. Cl.
CPC ..... *H01Q 9/0407* (2013.01); *H01Q 1/38* (2013.01); *H01Q 5/321* (2015.01); *H01Q 5/371* (2015.01)

(58) Field of Classification Search
CPC ..... H01Q 9/0407; H01Q 5/371; H01Q 5/321; H01Q 1/38
See application file for complete search history.

(56) References Cited

U.S. PATENT DOCUMENTS 3,938,161 A 2/1976 Sanford
7,055,754 B2 * 6/2006 Forster ..... G06K 19/07749 235/492
(Continued)

FOREIGN PATENT DOCUMENTS

CN 101320837 A 12/2008
CN 101345337 A 1/2009
(Continued)

*Primary Examiner* — Dameon E Levi
*Assistant Examiner* — Hasan Islam
(74) *Attorney, Agent, or Firm* — Slater Matsil, LLP

(57) ABSTRACT

The present invention disclose a printed antenna, so as to increase power and a frequency band width of an antenna. The printed antenna includes a printed circuit board, an antenna pattern, and a signal feed-in point, where the antenna pattern is printed on a front surface of the printed circuit board, and the antenna pattern includes a first antenna pattern, a second antenna pattern, and a third antenna pattern; the signal feed-in point is connected to the second antenna pattern; one end of a side, of the first antenna pattern is connected to the second antenna pattern; the second antenna pattern is vertically laid out in parallel to an edge of the printed circuit board; and the third antenna pattern includes a first part and a second part, and the first part and the second part are arranged in parallel in the non-closed rectangle.

20 Claims, 4 Drawing Sheets

(51) Int. Cl.
*H01Q 5/321* (2015.01)
*H01Q 5/371* (2015.01)

(56) References Cited

U.S. PATENT DOCUMENTS

| | | | | |
|---|---|---|---|---|
| 8,193,973 | B2 * | 6/2012 | Morton | H01P 1/2005 29/600 |
| 8,587,494 | B2 * | 11/2013 | Lee | H01Q 1/243 343/700 MS |
| 8,963,780 | B2 * | 2/2015 | Hsu | H01Q 1/243 343/700 MS |
| 2003/0122722 | A1 | 7/2003 | Sugiyama et al. | |
| 2005/0062657 | A1 * | 3/2005 | Lin | G06F 1/1616 343/702 |
| 2011/0181487 | A1 | 7/2011 | Kim et al. | |
| 2012/0007782 | A1 | 1/2012 | Nishio et al. | |
| 2012/0306703 | A1 | 12/2012 | Komaki et al. | |

FOREIGN PATENT DOCUMENTS

| | | | |
|---|---|---|---|
| CN | 201741807 | U | 2/2011 |
| CN | 102117966 | A | 7/2011 |
| CN | 202712428 | U | 1/2013 |
| EP | 1162688 | A1 | 12/2001 |
| EP | 2104178 | A1 | 9/2009 |
| EP | 2182583 | A1 | 5/2010 |
| JP | 7193417 | A | 7/1995 |
| JP | H10284932 | A | 10/1998 |
| JP | 2004236273 | A | 8/2004 |
| JP | 2011061638 | A | 3/2011 |
| JP | 2011509624 | A | 3/2011 |
| JP | 201219281 | A | 1/2012 |
| WO | 0124316 | A1 | 4/2001 |
| WO | 2005062422 | A1 | 7/2005 |
| WO | 2008087780 | A1 | 7/2008 |
| WO | 2009028251 | A1 | 3/2009 |
| WO | 2009118565 | A1 | 10/2009 |
| WO | 2011102017 | A1 | 8/2011 |

* cited by examiner

PRINTED ANTENNA AND TERMINAL DEVICE

This application is a continuation of International Application No. PCT/CN2014/082014, filed on Jul. 11, 2014, which claims priority to Chinese Patent Application No. 201310329288.2, filed on Jul. 31, 2013, both of which are hereby incorporated by reference in their entireties.

TECHNICAL FIELD

The present invention relates to the field of wireless communications technologies, and in particular, to a printed antenna and a terminal device.

BACKGROUND

With rapid development of mobile communications technologies, functions of a terminal product become increasingly diverse, and product dimensions tend to be compact, which impose a harsher and stricter requirement on a terminal antenna. At present, LTE (Long Term Evolution) products have gradually been put into commercial use, and some terminal products are also required to support an LTE frequency band. Because a bandwidth of the LTE frequency band is much broader than that of a 2G (the second generation mobile telecommunications technology) frequency band and that of a 3G (the third generation mobile telecommunications technology) frequency band. The LTE frequency band (698 MHz to 960 MHz, 1710 MHz to 2690 MHz) imposes a new requirement on a bandwidth of an antenna. A conventional antenna cannot satisfy a requirement for a sufficient bandwidth. In addition, because LTE communications imposes a quite high requirement on the antenna, antenna efficiency (a ratio of power radiated by an antenna to active power input into the antenna, where a numerical value of the ratio is constantly less than 1) cannot be too low (at least greater than 35% at the frequency band of 698 MHz to 960 MHz, and at least greater than 45% at the frequency band of 1710 MHz to 2690 MHz).

In the prior art, a structure of a terminal antenna is shown in FIG. 1, where 101 is a PCB (printed circuit board), 102 is an antenna pattern, and 103 is a signal feed-in point. The signal feed-in point is a connection point of an antenna and a connection point of a radio frequency circuit to feed in or feed out a signal. A size of the antenna is further reduced by means of printing the antenna on the PCB, but the power of the antenna is low and the bandwidth is narrow. Still further, a radio frequency circuit with an antenna may implement double resonance of a high frequency and a low frequency by adding a matching circuit, which may increase a resonance point, but cannot improve efficiency of the antenna, and also restricts improvement of the bandwidth.

SUMMARY

In view of this, an objective of the present invention is to provide a printed antenna and a terminal device, so that in a case in which an external device, such as an inductor or a capacitor, does not need to be connected to perform matching, a bandwidth of an antenna satisfies a requirement of a current LTE full frequency band, especially broadening a low frequency bandwidth of the antenna. Further, efficiency of the antenna at a high frequency band is improved.

According to a first aspect, a printed antenna is provided, where the printed antenna includes a printed circuit board, an antenna pattern, and a signal feed-in point, where the antenna pattern is printed on a front surface of the printed circuit board, and the antenna pattern includes a first antenna pattern, a second antenna pattern, and a third antenna pattern; the signal feed-in point is connected to the second antenna pattern; one end of a side, which is laid out along an edge of the printed circuit board, of the first antenna pattern is connected to the second antenna pattern; the second antenna is vertically laid out in parallel to an edge of the printed circuit board, where the second antenna pattern and the first antenna pattern form a non-closed rectangular; and the third antenna pattern includes a first part and a second part, where one end of the first part of the third antenna pattern is connected to the first antenna pattern, and one end of the second part of the third antenna pattern is connected to the second antenna pattern, and the first part and the second part are arranged in parallel in the non-closed rectangle.

In a first possible implementation manner of the first aspect, the printed antenna further includes a welding device, where that one end of the first part is connected to the first antenna pattern is specifically that: one end of the first part is connected to the first antenna pattern by using the welding device; and/or that one end of the second part is connected to the second antenna pattern is specifically that: one end of the second part is connected to the second antenna pattern by using the welding device.

With reference to the first aspect, or the first possible implementation manner of the first aspect, in a second possible implementation manner, the first part of the third antenna pattern includes at least two components, and the at least two components are connected by using the welding device; and/or the second part of the third antenna pattern includes at least two components, and the at least two components are connected by using the welding device.

With reference to the first aspect, or either of the foregoing possible implementation manners, in a third possible implementation manner, the first part of the third antenna pattern includes a width, a length, a shape, or a quantity, and the width, the length, the shape, or the quantity of the first part may be set to a fixed value; and/or the second part of the third antenna pattern includes a width, a length, a shape, or a quantity, and the width, the length, the shape, or the quantity of the second part may be set to a fixed value.

In a fourth possible implementation manner of the first aspect, the first antenna pattern includes a width and a length of the first antenna pattern, and the width and the length of the first antenna pattern may be set to a fixed value.

In a fifth possible implementation manner of the first aspect, the second antenna pattern includes a width and a length of the second antenna pattern, and the width and the length of the second antenna pattern may be set to a fixed value.

With reference to the first possible implementation manner of the first aspect, or the second possible implementation manner of the first aspect, in a sixth possible implementation manner of the first aspect, the welding device includes at least one of the following: a capacitor, an inductor, or a resistor.

According to a second aspect, a terminal device is provided, where the terminal device includes: at least one printed antenna according to the first aspect and any one of the foregoing possible implementation manners, and a communications module, where the communications module is configured to access a wireless network by using the printed antenna.

In a first possible implementation manner, the terminal device includes at least two printed antennas, where a first printed antenna is a primary antenna of the terminal device, and a second printed antenna is a secondary antenna of the terminal device; and the second printed antenna is a diversity antenna of the terminal device and implements diversity reception of a signal together with the first printed antenna.

With reference to the second aspect, or the first possible implementation manner of the second aspect, in a second possible implementation manner, the terminal device is specifically a data card, a wireless network interface card, a modem, a mobile phone, a portable computer that has a function of surfing the Internet, or a device that can perform wireless communication.

Based on the foregoing technical solutions, it is implemented that a bandwidth of a printed antenna satisfies a requirement of a current LTE full frequency band in a case in which a matching circuit does not need to be added, especially, a low frequency bandwidth of the antenna is broadened, which resolves a problem that a high frequency bandwidth is too broad, and meanwhile improves efficiency of the antenna at the full frequency band. Further, the printed antenna is printed on a printed circuit board, which requires no or few matching devices, thereby effectively reducing costs.

BRIEF DESCRIPTION OF THE DRAWINGS

To describe the technical solutions in the embodiments of the present invention more clearly, the following briefly introduces the accompanying drawings required for describing the embodiments of the present invention. The accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. It should be understood that the described embodiments are a part rather than all of the embodiments of the present invention. All other embodiments obtained by a person of ordinary skill in the art based on the embodiments of the present invention without creative efforts shall fall within the protection scope of the present invention.

At present, in wireless communications technologies, a printed antenna is used to perform communication. However, a matching circuit needs to be added to implement double resonance of a high frequency and a low frequency. As a result, a size of the antenna cannot be reduced, and further, a low frequency bandwidth of the printed antenna cannot satisfy an LTE communications requirement, which leads to low efficiency of the antenna. Embodiments of the present invention provide a printed antenna that can satisfy a requirement of a current LTE full frequency band. Especially, a low frequency bandwidth of the antenna is broadened, which resolves a problem that a high frequency bandwidth is too broad, and meanwhile improves efficiency of the antenna at the full frequency band. Further, the printed antenna is printed on a printed circuit board, which requires no or few matching devices, thereby effectively reducing costs.

Figure 1:
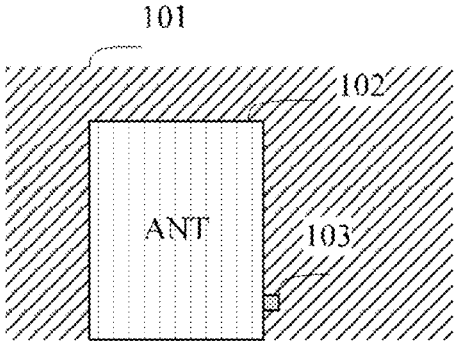
FIG. 1 (Prior Art)
FIG. 1 is a schematic structural diagram of a printed antenna in the prior art.
Figure 2:
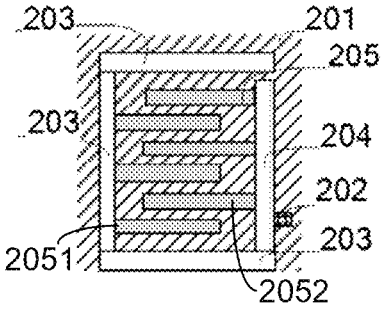
FIG. 2 is a schematic structural diagram of a printed antenna according to an embodiment of the present invention.

FIG. 2 is a schematic structural diagram of a printed antenna according to an embodiment of the present invention. As shown in FIG. 2, the printed antenna includes: a printed circuit board 201, an antenna pattern, and a signal feed-in point 202, where the antenna pattern is printed on a front surface of the printed circuit board 201.

The antenna pattern includes: a first antenna pattern 203, a second antenna pattern 204, and a third antenna pattern 205.

The signal feed-in point 202 is connected to the second antenna pattern 204.

One end of a side, which is laid out along an edge of the printed circuit board 201, of the first antenna pattern 203 is connected to the second antenna pattern 204.

The second antenna pattern 204 is vertically laid out in parallel to an edge of the printed circuit board 201, where the second antenna pattern 204 and the first antenna pattern 203 form a non-closed rectangular.

The third antenna pattern 205 includes a first part 2051 and a second part 2052, where one end of the first part 2051 of the third antenna pattern 205 is connected to the first antenna pattern 203, and one end of the second part 2052 of the third antenna pattern 205 is connected to the second antenna pattern 204, and the first part 2051 and the second part 2052 are arranged in parallel in the non-closed rectangle.

In this embodiment of the present invention, one side of the first antenna pattern 203 is laid out along an edge of the printed circuit board 201, and other sides of the antenna pattern 203 are laid out around a metal ground of the printed circuit board 201. The signal feed-in point 202 is connected to the second antenna pattern 204, and is disposed near the edge of the printed circuit board 201. Electromagnetic coupling is generated between the first antenna pattern 203 and the metal ground of the printed circuit board 201 and a low frequency band of an antenna radiation bandwidth is generated. A specific low frequency band may be 698 MHz to 960 MHz. A length of the first antenna pattern 203 may be set, and a width of a gap between the first antenna pattern 203 and the printed circuit board 201 may also be set.

The second antenna pattern 204 is vertically laid out in parallel to the edge of the printed circuit board 201, and one end of the side, which is laid out along the edge of the printed circuit board 201, of the first antenna pattern 203 is connected to the second antenna pattern 204, where the second antenna pattern 204 and the first antenna pattern 203 form a non-closed rectangular. The second antenna pattern 204 generates a high frequency band of the antenna radiation bandwidth by means of radiation, and a specific high frequency band may be 2 GHz to 3 GHz. A length of the second antenna pattern 204 may be set, and a width of a gap between the second antenna pattern 204 and the printed circuit board 201 may also be set.

The third antenna pattern 205 includes a first part 2051 and a second part 2052, where one end of the first part 2051 is connected to the first antenna pattern 203, and one end of the second part 2052 is connected to the second antenna pattern 204, and the first part 2051 and the second part 2052 are arranged in parallel in the non-closed rectangle. By radiation of the second part 2052 and mutual coupling between the first part 2051 and the second part 2052, the first part 2051 and the second part 2052, which are alternately arranged in parallel, of the third antenna pattern 205 generate a high frequency band of the antenna radiation bandwidth, where specifically, the high frequency band may be 1.71 GHz to 2.17 GHz. A width, length, shape or quantity of the first part 2051 of the third antenna pattern 205 may be set to a fixed value, and a width, length, shape, or quantity of the second part 2052 of the third antenna pattern 205 may also be set to a fixed value.

In another embodiment of the present invention, the printed antenna further includes a welding device, where the welding device may include at least one of the following: an inductor, a capacitor, a resistor, or the like. One end of the first part 2051 of the third antenna pattern 205 is connected to the first antenna pattern 203 by using the welding device, and/or one end of the second part 2052 of the third antenna pattern 205 is connected to the second antenna pattern 204 by using the welding device.

In another embodiment of the present invention, the third antenna pattern 205 includes a first part 2051 and a second part 2052. The first part 2051 of the third antenna pattern 205 includes at least two components, where the at least two components are connected by using the welding device, and the length of the first part 2051 of the third antenna pattern 205 may be adjusted by adding a welding device; and/or the second part 2052 of the third antenna pattern 205 includes at least two components, where the at least two components are connected by using the welding device, and the length of the second part 2052 of the third pattern 205 is adjusted by adding a welding device.

Figure 3:
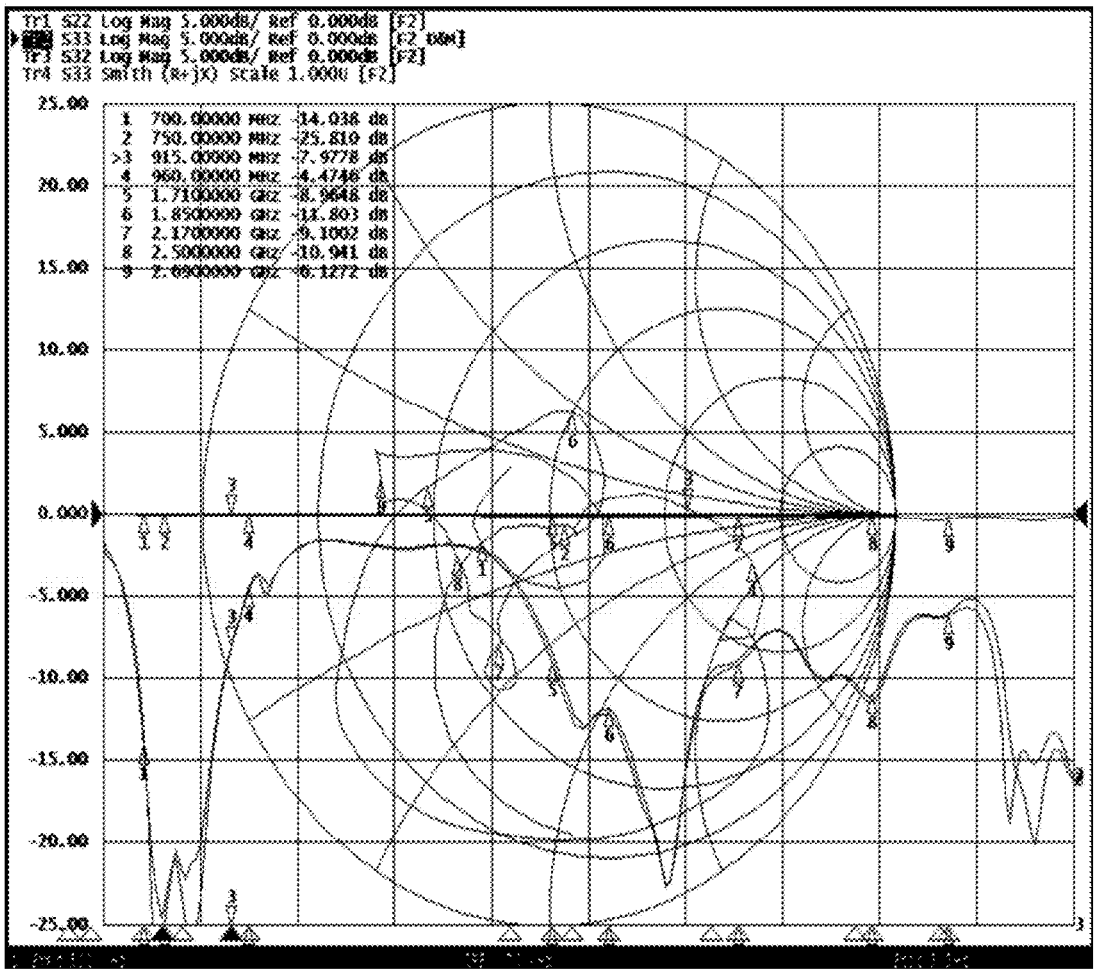
FIG. 3 is a Smith chart of a printed antenna measured in an embodiment of the present invention.

FIG. 3 is a Smith chart of a printed antenna measured in an embodiment of the present invention, where the Smith chart is a polar coordinate chart of a reflection factor (represented by the symbol Γ), and the reflection factor may be defined as a one-port scattering parameter, that is S11. In FIG. 3, the vertical coordinate is a reflection factor (S11), and the horizontal coordinate is a frequency. It can be seen from measured results in FIG. 3 that, scattering curves at a low frequency band and high frequency band that are of an antenna and measured based on the printed antenna in this embodiment of the present invention converge, and all curves approach a center of the smith chart. Therefore, it indicates that a matching circuit does not need to be added to the printed antenna in this embodiment of the present invention, and an effect of impedance matching and the reflection factor being close to 1 can be achieved.

Table 1 is antenna efficiency actually measured in this embodiment of the present invention. Efficiency, which is measured based on this embodiment of the present invention, of an antenna at low frequency band and at high frequency band respectively can be seen in Table 1.

TABLE 1

| Frequency | Efficiency (%) |
|---|---|
| 698 | 67.1 |
| 711 | 73.5 |
| 731 | 78.4 |
| 751 | 76.4 |
| 771 | 73.9 |
| 791 | 74.0 |
| 810 | 66.8 |
| 830 | 62.9 |
| 850 | 61.1 |
| 870 | 58.1 |
| 890 | 53.7 |
| 910 | 47.6 |
| 930 | 46.4 |
| 950 | 34.7 |
| 960 | 28.4 |
| 1710 | 43.2 |
| 1730 | 49.5 |
| 1750 | 51.1 |
| 1770 | 54.5 |
| 1790 | 53.2 |
| 1810 | 57.7 |
| 1830 | 58.5 |
| 1850 | 58.7 |
| 1870 | 59.6 |
| 1890 | 60.6 |
| 1910 | 61.2 |
| 1930 | 61.7 |
| 1950 | 65.1 |
| 1970 | 63.5 |
| 1990 | 61.9 |
| 2010 | 60.1 |
| 2030 | 60.1 |
| 2050 | 57.4 |
| 2070 | 58.8 |
| 2090 | 58.1 |
| 2110 | 58.3 |
| 2130 | 57.5 |
| 2150 | 53.6 |
| 2170 | 59.0 |
| 2190 | 55.5 |
| 2300 | 60.2 |
| 2350 | 59.5 |
| 2400 | 60.3 |
| 2450 | 59.9 |
| 2500 | 60.2 |
| 2520 | 57.7 |
| 2540 | 58.6 |
| 2560 | 60.8 |
| 2580 | 53.9 |
| 2600 | 53.8 |
| 2620 | 48.6 |
| 2640 | 50.3 |
| 2660 | 49.8 |
| 2680 | 47.5 |
| 2690 | 47.7 |
| 2700 | 47.3 |

In Table 1, measured antenna efficiency at a low frequency band (698 MHz to 950 MHz) is higher than 35%, and measured antenna efficiency at a high frequency band (1.71 GHz to 2.7 GHz) is higher than 45%.

In this embodiment of the present invention, a printed antenna that can increase a bandwidth is designed. A first antenna pattern is connected to a second antenna pattern to form a non-closed rectangular, and a third antenna pattern is arranged in parallel in the non-closed rectangle, and is separately connected to the first antenna pattern and the second antenna pattern. The printed antenna can satisfy a requirement of a low frequency bandwidth of LTE communication (as low as 700 MHz), and efficiency of the printed antenna is effectively improved at a full frequency band. Further, the printed antenna may implement a coverage of an LTE full frequency band with no or few matching devices, which facilitates integration of the printed antenna in a terminal product, so as to satisfy a requirement of product miniaturization, and effectively reduce costs.

Figure 4:
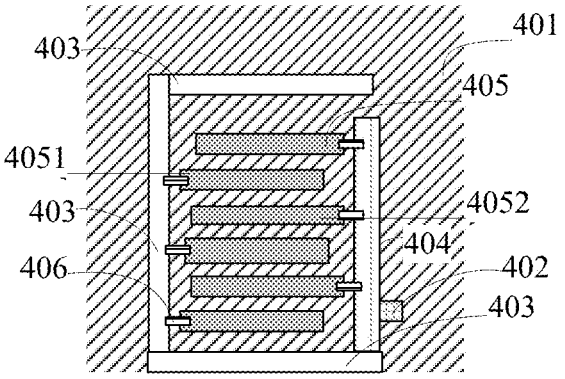
FIG. 4 is a schematic structural diagram of a printed antenna according to another embodiment of the present invention.

FIG. 4 is a schematic structural diagram of a printed antenna according to another embodiment of the present invention. As shown in FIG. 4, the printed antenna includes: a printed circuit board 401, an antenna pattern, and a signal feed-in point 402, where the antenna pattern is printed on a front surface of the printed circuit board 401.

The antenna pattern includes: a first antenna pattern 403, a second antenna pattern 404, a third antenna pattern 405, and a welding device 406.

The signal feed-in point 402 is connected to the second antenna pattern 404.

One end of a side, which is laid out along an edge of the printed circuit board 401, of the first antenna pattern 403 is connected to the second antenna pattern 404.

The second antenna pattern 404 is vertically laid out in parallel to an edge of the printed circuit board 401, where the second antenna pattern 404 and the first antenna pattern 403 form a non-closed rectangular.

The third antenna pattern 405 includes a first part 4051 and a second part 4052, where one end of the first part 4051 of the third antenna pattern 405 is connected to the first antenna pattern 403, and one end of the second part 4052 of the third antenna pattern 405 is connected to the second antenna pattern 404, and the first part 4051 and the second part 4052 are arranged in parallel in the non-closed rectangle.

The welding device 406 may include at least one of the following: an inductor, a capacitor, a resistor, or the like. One end of the first part 4051 of the third antenna pattern 405 is connected to the first antenna pattern 403 by using the welding device 406, and/or one end of the second part 4052 of the third antenna pattern 405 is connected to the second antenna pattern 404 by using the welding device 406. By using the welding device 406 to connect the first antenna pattern 403 to the first part 4051 of the third antenna pattern 405, and to connect the second antenna pattern 404 to the second part 4052 of the third antenna pattern 405, a connection position between the first antenna pattern 403 and the first part 4051 of the third antenna pattern 405 may be adjusted, and a connection position between the second antenna pattern 404 and the second part 4052 of the third antenna pattern 405 may also be adjusted, and a high-frequency resonance point of the printed antenna may be adjusted, so as to selectively increase radiation power of some resonance frequencies.

In this embodiment of the present invention, a printed antenna that can increase a bandwidth is designed. A first antenna pattern is connected to a second antenna pattern to form a non-closed rectangular, and a third antenna pattern is arranged in parallel in the non-closed rectangle, and is separately connected to the first antenna pattern and the second antenna pattern. The printed antenna can satisfy a requirement of a low frequency bandwidth of LTE communication (as low as 700 MHz), and efficiency of the printed antenna is effectively improved at a full frequency band. The antenna adjusts a length and a position of a first part and a second part of a third antenna pattern by using a welding device, and a high-frequency resonance point may be adjusted, so as to increase power of some frequencies. Further, the printed antenna may implement a coverage of an LTE full frequency band with no or few matching devices, which facilities integration of the printed antenna in a terminal product, so as to satisfy a requirement of product miniaturization, and effectively reduce costs.

Figure 5:
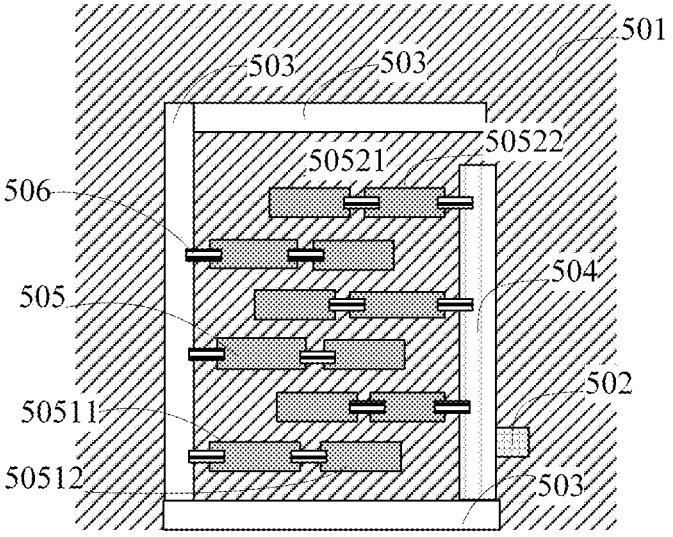
FIG. 5 is a schematic structural diagram of a printed antenna according to still another embodiment of the present invention.

FIG. 5 is a schematic structural diagram of a printed antenna according to still another embodiment of the present invention. As shown in FIG. 5, the printed antenna includes a printed circuit board 501, an antenna pattern, and a signal feed-in point 502, where the antenna pattern is printed on a front surface of the printed circuit board 501.

The antenna pattern includes: a first antenna pattern 503, a second antenna pattern 504, a third antenna pattern 505, and a welding device 506.

The signal feed-in point 502 is connected to the second antenna pattern 504.

One end of a side, which is laid out along an edge of the printed circuit board 501, of the first antenna pattern 503 is connected to the second antenna pattern 504.

The second antenna pattern 504 is vertically laid out in parallel to an edge of the printed circuit board 501, where the second antenna pattern 504 and the first antenna pattern 503 form a non-closed rectangular.

The third antenna pattern 505 includes a first part 5051 and a second part 5052, where one end of the first part 5051 of the third antenna pattern 505 is connected to the first antenna pattern 503, and one end of the second part 5052 of the third antenna pattern 505 is connected to the second antenna pattern 504, and the first part 5051 and the second part 5052 are arranged in parallel in the non-closed rectangle.

The welding device 506 may include at least one of the following: an inductor, a capacitor, a resistor, or the like. One end of the first part 5051 of the third antenna pattern 505 is connected to the first antenna pattern 503 by using the welding device 506, and/or one end of the second part 5052 of the third antenna pattern 505 is connected to the second antenna pattern 504 by using the welding device 506.

The first part 5051 of the third antenna pattern 505 includes a first component 50511 and a second component 50512, where the first component 50511 of the first part 5051 of the third antenna pattern 505 may be connected to the second component 50512 of the first part 5051 by using the welding device 506; and/or the second part 5052 of the third antenna pattern 505 includes a first component 50521 and a second component 50522, where the first component 50521 of the second part 5052 of the third antenna pattern 505 may be connected to the second component 50522 of the second part 5052 by using the welding device 506.

Optionally, the first part 5051 of the third antenna pattern 505 includes at least two components, where the at least two components are connected by using the welding device 506, so as to adjust a length of the first part 5051 of the third antenna pattern 505.

Optionally, the second part 5052 of the third antenna pattern 505 includes at least two components, where the at least two components are connected by using the welding device 506, so as to adjust a length of the second part 5052 of the third antenna pattern 505.

By using the welding device 506 to connect the first antenna pattern 503 to the first part 5051 of the third antenna pattern 505, to connect the second antenna pattern 504 to the second part 5052 of the third antenna pattern 505, to connect the first component 50511 of the first part 5051 of the third antenna pattern 505 to the second component 50512, and to connect the first component 50521 of the second part 5052 of the third antenna pattern 505 to the second component 50522, a high-frequency resonance point of the printed antenna may be adjusted, so as to selectively increase radiation power of some resonance frequencies.

In this embodiment of the present invention, a printed antenna that can increase a bandwidth is designed. Three sides of a first antenna pattern and a second antenna pattern form a non-closed rectangular, and two parts of a third antenna pattern are alternately arranged in parallel, and are separately connected to the first antenna pattern and the second antenna pattern. The printed antenna can satisfy a requirement of a low frequency bandwidth of LTE communication (as low as 700 MHz), and efficiency of the printed antenna is effectively improved at a full frequency band. The antenna adjusts a position of a pattern, which is alternately arranged in parallel, of the third antenna pattern by using a welding device, and a high-frequency resonance point may be adjusted, so as to increase power of some frequencies. Further, the printed antenna may implement a coverage of an LTE full frequency band with no or few matching devices, which facilitates integration of the printed antenna in a terminal product, so as to satisfy a requirement of product miniaturization, and effectively reduce costs.

Figure 6:
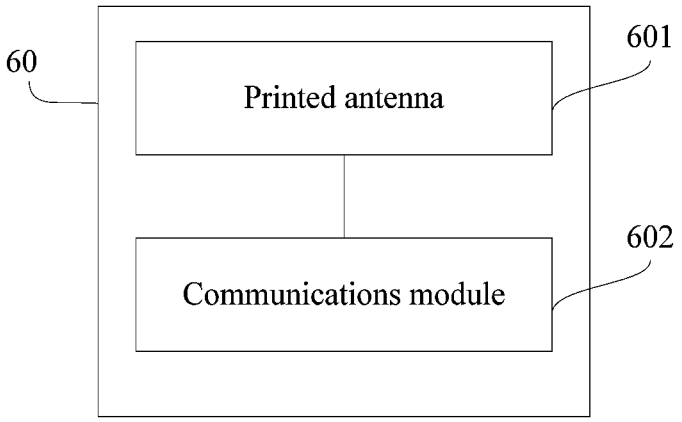
FIG. 6 is a schematic structural diagram of a terminal device according to an embodiment of the present invention.

FIG. 6 is a schematic structural diagram of a terminal device according to an embodiment of the present invention. As shown in FIG. 6, the terminal device 60 includes: at least one printed antenna 601 and a communications module 602.

The printed antenna 601 includes a printed circuit board, an antenna pattern, and a signal feed-in point, where the antenna pattern is printed on a front surface of the printed circuit board, and the antenna pattern includes a first antenna pattern, a second antenna pattern, and a third antenna pattern; the signal feed-in point is connected to the second antenna pattern; one end of a side, which is laid out along an edge of the printed circuit board, of the first antenna pattern is connected to the second antenna pattern; the second antenna pattern is vertically laid out in parallel to an edge of the printed circuit board, where the second antenna pattern and the first antenna form a non-closed rectangular; and the third antenna pattern includes a first part and a second part, where one end of the first part of the third antenna pattern is connected to the first antenna pattern, and one end of the second part of the third antenna pattern is connected to the second antenna pattern, and the first part and the second part are arranged in parallel in the non-closed rectangle.

The communications module 602 is configured to access a wireless network by using the printed antenna.

Figure 7:
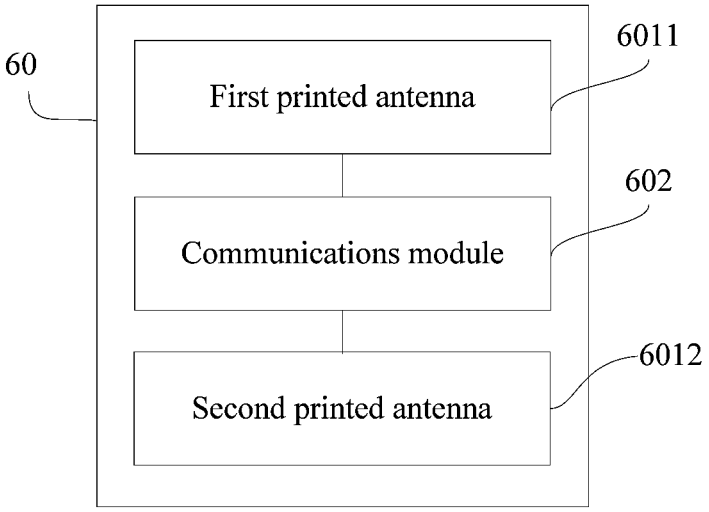
FIG. 7 is a schematic structural diagram of a terminal device according to another embodiment of the present invention.

FIG. 7 is a schematic structural diagram of a terminal device according to another embodiment of the present invention. As shown in FIG. 7, in the another embodiment of the present invention, the terminal device includes at least two printed antennas, where a first printed antenna 6011 is a primary antenna of the terminal device 60, and a second printed antenna 6012 is a secondary antenna of the terminal device 60; and the second printed antenna 6012 is a diversity antenna of the terminal device 60 and implements diversity reception of a signal together with the first printed antenna.

The terminal device 60 may include at least one of the following: a data card, a wireless network interface card, a modem, a mobile phone, a portable computer that has a function of surfing the Internet, or a device that can perform wireless communication. In addition, the printed antenna 601 may also be configured to implement functions such as Bluetooth, WIFI (Wireless Fidelity), GPS (Global Positioning System).

In this embodiment of the present invention, a printed antenna that can increase a bandwidth is designed. A first antenna pattern is connected to a second antenna pattern to form a non-closed rectangular, and a third antenna pattern is arranged in parallel in the non-closed rectangle, and is separately connected to the first antenna pattern and the second antenna pattern. The printed antenna can satisfy a requirement of a low frequency bandwidth of LTE communication (as low as 700 MHz), and efficiency of the printed antenna is effectively improved at a full frequency band. The antenna adjusts a position of a pattern, which is alternately arranged in parallel, of the third antenna pattern by using a welding device, and a high-frequency resonance point may be adjusted, so as to increase power of some frequencies. Further, the printed antenna may implement a coverage of an LTE full frequency band with no or few matching devices, which facilitates integration of the printed antenna in a terminal product, so as to satisfy a requirement of product miniaturization, and effectively reduce costs.

A person of ordinary skill in the art may be aware that, in combination with the examples described in the embodiments disclosed in this specification, units and algorithm steps may be implemented by a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing apparatus and unit, reference may be made to a corresponding process in the foregoing method embodiments, and details are not described herein again.

In the several embodiments provided in the present application, it should be understood that the disclosed server and method may be implemented in other manners. For example, the described server embodiment is merely exemplary. For example, the unit division is merely logical function division and may be other division in an actual implementation. For example, a plurality of units or components may be combined or integrated into another system, or some features may be ignored or not performed. Furthermore, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments of the present invention.

In addition, functional units in the embodiments of the present invention may be integrated into one processing unit, or each of the units may exist alone physically, or two or more units are integrated into one unit.

A person of ordinary skill in the art may understand that all or a part of the steps of the method embodiments may be implemented by a program instructing relevant hardware. The program may be stored in a computer readable storage medium. When the program runs, the steps of the method embodiments are performed. The foregoing storage medium includes any medium that can store program code, such as a ROM, a RAM, a magnetic disk, or an optical disc.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A printed antenna comprising:

a printed circuit board;

an antenna pattern printed on a front surface of the printed circuit board, the antenna pattern comprising:

a first antenna pattern comprising a plurality of sides of an open rectangle and that include a first side, a second side and a third side, a first portion of the first antenna pattern forming the first side and having a first antenna edge disposed at a first board edge of the printed circuit board, and a second portion of the first antenna pattern forming the second side and the third side of the open rectangle and extending around a metal ground of the printed circuit board;

a second antenna pattern laid out along a second board edge of the printed circuit board, the second antenna pattern forming at least a part of a fourth side of the open rectangle, the second antenna pattern having a first end connected to an end of a second edge of the first portion of the first antenna pattern, the second edge of the first portion of the first antenna pattern being parallel to the first board edge of the printed circuit board and further being opposite the first portion of the first antenna pattern from the first antenna edge, wherein the second portion of the first antenna pattern extends past a second end of the second antenna pattern, wherein the second end of the second antenna pattern is spaced apart from the second portion of the first antenna pattern by first spacing that forms a gap of the open rectangle; and a third antenna pattern disposed within the open rectangle, the third antenna pattern comprising a first part and a second part, the first part and the second part being arranged in parallel, an end of the first part being connected to the first antenna pattern, the first part extending from the first antenna pattern parallel to the first board edge, an end of the second part being connected to the second antenna pattern; and a signal feed-in point connected to the second antenna pattern.

2. The printed antenna of claim 1, further comprising a welding device.

3. The printed antenna of claim 2, wherein the welding device connects the first antenna pattern to the end of the first part of the third antenna pattern.

4. The printed antenna of claim 2, wherein the welding device connects the second antenna pattern to the end of the second part of the third antenna pattern.

5. The printed antenna of claim 2, wherein the welding device comprises at least one of a capacitor, an inductor, or a resistor.

6. The printed antenna of claim 1, wherein the first part of the third antenna pattern comprises at least two components connected by a welding device.

7. The printed antenna of claim 1, wherein the second part of the third antenna pattern comprises at least two components connected by a welding device.

8. The printed antenna of claim 1, wherein the first part of the third antenna pattern comprises a width, a length, a shape, or a quantity that is set to a fixed value.

9. The printed antenna of claim 8, wherein the fixed value is selected to implement coverage of a LTE full frequency band.

10. The printed antenna of claim 1, wherein the second part of the third antenna pattern comprises a width, a length, a shape, or a quantity that is set to a fixed value.

11. The printed antenna of claim 10, wherein the fixed value is selected to implement coverage of a LTE full frequency band.

12. The printed antenna of claim 1, wherein the first antenna pattern comprises a width and a length that is set to a fixed value.

13. The printed antenna of claim 12, wherein the fixed value is selected to implement coverage of a LTE full frequency band.

14. The printed antenna of claim 1, wherein the second antenna pattern comprises a width and a length that is set to a fixed value.

15. The printed antenna of claim 14, wherein the fixed value is selected to implement coverage of a LTE full frequency band.

16. The printed antenna of claim 1, wherein the first antenna pattern is sized, and the second portion of the first antenna pattern is arranged around the metal ground of the printed circuit board such that, in use, electromagnetic coupling is generated between the second portion of the first antenna pattern and the metal ground of the printed circuit board, wherein the electromagnetic coupling generates a low frequency band of a first antenna radiation that is between about 698 MHz to 960 MHz; and wherein the second antenna is arranged and sized such that the second antenna generates a high frequency band of a second antenna radiation that s between about 2 GHz to 3 GHz.

17. A terminal device comprising:

a printed antenna comprising:

a printed circuit board;

an antenna pattern printed on a front surface of the printed circuit board, the antenna pattern comprising:

a first antenna pattern comprising a plurality of sides of an open rectangle and that include a first side, a second side and a third side, a first portion of the first antenna pattern forming the first side and having a first antenna edge disposed at a first board edge of the printed circuit board, and a second portion of the first antenna pattern forming the second side and the third side of the open rectangle and extending around a metal ground of the printed circuit board;

a second antenna pattern laid out along a second board edge of the printed circuit board, the second antenna pattern forming at least a part of a fourth side of the open rectangle, the second antenna pattern having a first end connected to an end of a second edge of the first portion of the first antenna pattern, the second edge of the first portion of the first antenna pattern being parallel to the first board edge of the printed circuit board and further being opposite the first portion of the first antenna pattern from the first antenna edge, wherein the second portion of the first antenna pattern extends past a second end of the second antenna pattern, wherein the second end of the second antenna pattern is spaced apart from the second portion of the first antenna pattern by first spacing that forms a gap of the open rectangle; and a third antenna pattern disposed within the third antenna pattern comprising a first part and a second part, the first part and the second part being arranged in parallel, an end of the first part being connected to the to the first antenna pattern, the first part extending from the first antenna pattern parallel to the first board edge, an end of the second part being connected to the second antenna pattern; and a signal feed-in point connected to the second antenna pattern; and a communications module configured to access a wireless network through the printed antenna.

18. The terminal device of claim 17, further comprising at least two printed antennas, wherein a first printed antenna is a primary antenna, and a second printed antenna is a secondary antenna.

19. The terminal device of claim 17, wherein the terminal device comprises one of a data card, a wireless network interface card, a modem, a mobile phone, a personal computer, or a device that can perform wireless communication.

20. The terminal device of claim 17, wherein the first antenna pattern is sized, and the second portion of the first antenna pattern is arranged around the metal ground of the printed circuit board such that, in use, electromagnetic coupling is generated between the second portion of the first antenna pattern and the metal ground of the printed circuit board, wherein the electromagnetic coupling generates a low frequency band of a first antenna radiation that is between about 698 MHz to 960 MHz; and wherein the second antenna is arranged and sized such that the second antenna generates a high frequency band of a second antenna radiation that s between about 2 GHz to 3 GHz.

* * * * *